United States Patent [19]

McDonald et al.

[11] Patent Number: 4,848,452

[45] Date of Patent: Jul. 18, 1989

[54] TUBE BUNDLE SUPPORT DEVICE

[75] Inventors: Dennis K. McDonald, Massillon; Bernard M. McCoy, Medina, both of Ohio

[73] Assignee: The Babcock & Wilcox Company, New Orleans, La.

[21] Appl. No.: 174,301

[22] Filed: Mar. 28, 1988

[51] Int. Cl.[4] ..... F28F 9/04

[52] U.S. Cl. ..... 165/178; 248/49; 248/65; 122/510; 122/511

[58] Field of Search ..... 122/510, 511; 165/162, 165/178; 248/49, 58, 67.7, 74.1, 65

[56] References Cited

U.S. PATENT DOCUMENTS

| | | | |
|---|---|---|---|
| 1,150,138 | 8/1915 | Magee | 122/510 X |
| 1,852,363 | 4/1932 | Parent | 165/162 |
| 2,015,328 | 9/1935 | Wood | 122/510 X |
| 3,482,946 | 12/1969 | Shirk | 122/510 X |
| 4,665,866 | 5/1987 | Wepfer | 122/510 |

*Primary Examiner*—Randall L. Green
*Attorney, Agent, or Firm*—Robert J. Edwards

[57] ABSTRACT

A support device and structure for supporting horizontal tubes of a conventional or fluidized bed steam generator comprising a vertical tube for carrying plural pairs of support brackets. Each support bracket has a central sleeve with a pair of opposite extending tube hooks that taper in width from the sleeve, outwardly to an end of the tube hook. The ends of the tube hooks for each pair of support brackets extend toward each other, but are maintained at a distance from one another to avoid the accumulation of ash or other bed material. Welded-on nubs along the length of the support tube localize the axial position of the bracket pairs.

4 Claims, 1 Drawing Sheet

TUBE BUNDLE SUPPORT DEVICE

FIELD AND BACKGROUND OF THE INVENTION

The present invention relates in general to a tube supporting device, and in particular, to a new and useful device for supporting the tubes of a tube bundle, particularly the tubes of a fluidized bed stream generator.

U.S. Pat. No. 1,852,363 to Parent discloses clamps which have inverted saddles shaped to embrace around the sides of tubes in a heat exchanger. Each clamp is formed with a spacer abutting an adjacent clamp in order to separate a plurality of tubes in a direction transverse to the axis of the tubes. U.S. Pat. No. 4,220,199 to Romanos discloses a spacer structure for tubes in a heat exchanger. The structure includes an elongated continuous strip which extends transversely to the axis of the tubes and carries projections that are bent to embrace the tubes.

U.S. Pat. No. 4,356,795 to Loiez et al discloses a device for Securing a panel of heat exchanger tubes and utilizes a vertical tube having fins attached to opposite sides thereof. The fins carry a plurality of vertically spaced shoulders which embrace and support latches for engaging the bottom of heat exchanger tubes extending transversely to the vertical tube. Upper clamping parts are fixed to the fins for bearing down on the heat exchanger tubes and securing them to the vertical tube. Other references which show the use of an elongated support tube for carrying a plurality of transverse tubes are U.S. Pat. No. 2,893,698 to Nunninghoff and U.S. Pat. No. 4,100,889 to Chayes. U-shaped clamping structures for holding tubes to a wall are disclosed by U.S. Pat. No. 4,019,468 to Miles and U.S. Pat. No. 4,550,690 to Baugher.

Spacer plates with or without bent or added support fingers are taught by U.S. Pat. No. 3,575,236 to Romanos; U.S. Pat. No. 3,854,529 to Sagan; U.S. Pat. No. 3,929,189 to Lecon; U.S. Pat. No. 3,998,268 to Sagan and U.S. Pat. No. 4,589,618 to Fournier. Also, see U.S. Pat. No. 1,824,459 to Beckwith: U.S. Pat. No. 3,397,431 to Walker and U.S. Pat. No. 4,619,315 to Waryasz. Clamps for cables are taught by U.S. Pat. No. 2,081,974 to Arnold and U.S. Pat. No. 2,099,465 to Burleson.

SUMMARY OF THE INVENTION

The present invention is drawn to a support device for the tubes of tube bundles used in conventional or fluidized bed steam generators. Particularly in the case of fluidized bed steam generators, measures should be taken against the accumulation of particles and soot in and around the support arrangements for the tube bundles. This accumulation of soot not only reduces heat transfer efficiency, but also contributes to the corrosion of the tubes in the area of their supports.

According to the present invention, an elongated support member is advantageously provided in the form of a vertical support tube. Pairs of support brackets are fixed along the length of the support member or tube. Each bracket has a sleeve portion for embracing the support and at least one, but preferably two tube hooks extending on opposite sides of the sleeve portion. Each tube hook has a curved recess which faces the recess of an adjacent hook so that a tube of the tube bundle is embraced between the tube hooks of a pair of brackets. With a pair of tube hooks on each support bracket, a pair of heat exchanger tubes can be supported on opposite sides of the vertical support tube. Advantageously, the tube hooks taper in width in a direction outwardly from the sleeve portion. The tube hooks of the pair of brackets have outer ends which are spaced from each other to avoid an accumulation of particles in this area. Locating means are provided along the vertical support tube for fixing the location of each pair of support brackets.

Each support bracket is advantageously made in two identical halves which can be bolted or welded together. Each half carries one half of the sleeve portion so that the bracket halves embrace the vertical support tube. A complete support arrangement for a pair of tubes is thus formed of four identical bracket halves which are simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

The accompanying drawings, form a part of this specification, and the reference numerals designate like or corresponding parts throughout the drawings.

DESCRIPTION OF THE PREFERRED EMBODIMENT

Figure 1:
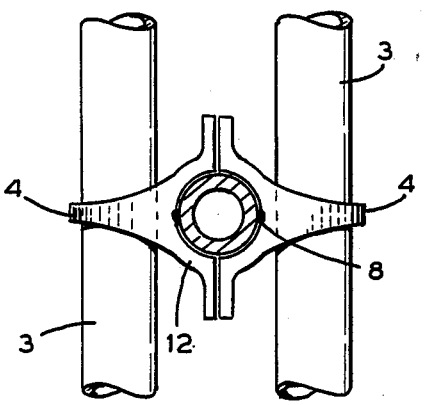
FIG. 1 is a top plan view of the support device of the present invention shown partly in section.

Referring to the drawings in particular, the invention embodied therein comprises a device generally designated 10 for supporting tubes 3 of a tube bundle. The tube bundle forms part of a heat exchanger such as a conventional or fluidized bed steam generator.

Figure 3:
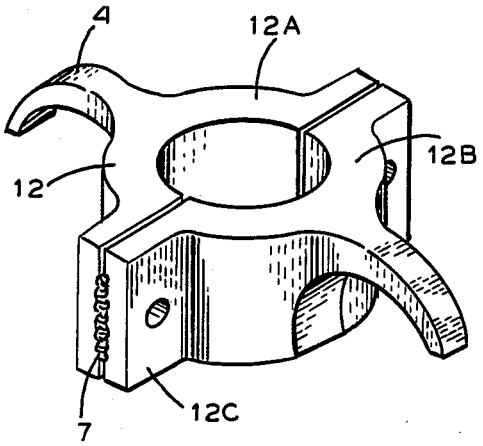
FIG. 3 is a perspective view of one support bracket of the present invention which is used in pairs to support a pair of heat exchanger tubes.
Figure 2:
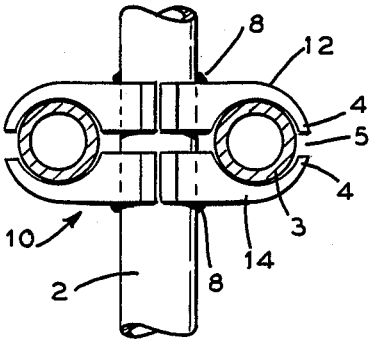
FIG. 2 is a side elevational view of the inventive support device with a pair of supported heat exchanger tubes shown in sectional view.
Figure 4:
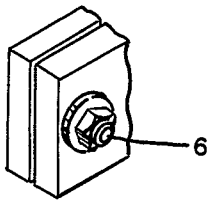
FIG. 4 shows an alternate mechanism for fastening halves of the support bracket together.

As best shown in FIGS. 1 and 2, the device comprises an elongated support member or tube 2 which, in the embodiment shown, extends vertically for supporting horizontally extending tubes 3. At spaced locations along its length, support member 2 has locating means in the form of welded-on beads or nubs 8. A pair of brackets 12 and 14 are fixed or localized at an axial location along support member 2 by the nubs 8. As shown in FIG. 3, each support bracket comprises two identical bracket halves 12A and 12B which face each other in mirror image fashion and can be fastened together either by welds 7, shown in FIG. 3, or bolts 6 shown in FIG. 4. Welds 7 and bolts 6 are connected across flange portions 12C of each bracket half. Each bracket half also includes a central sleeve portion having a semi-circular midsection with an inner face which defines a cylindrical space for embracing the support member 2.

Tube hooks 4 formed integrally with the sleeve portion extend outwardly an upper or lower edge of the outer face of from the sleeve portion of each bracket midway of the arc of the outer face of the midsection. As best shown in FIG. 1, each tube hook has a width which tapers in a direction outwardly from the central sleeve portion of its bracket. The ends of tube hooks 4 are also spaced from each other to define a clear space 5 as shown in FIG. 2. This, in conjunction with the tapering width of the tube hooks, avoids the accumulation of particles, soot or ash in the support structure.

Advantageously, the support device of the present invention uses four identical bracket halves arranged in mirror image with respect to each other for both the upper and lower brackets 12, 14. The bracket halves, as well as the support member 2, are advantageously made of suitable material for high temperature environment, such as an appropriate grade of steel or other alloy.

Advantages of the invention include a reduction of trapped ash or bed material and the fact that the support devices can be removed individually by cutting welds 7 or removing bolts 6. The invention avoids having to weld the dissimilar metals together, for example, an austenitic material support device to a ferritic tube.

Alternate clamping means, such as clips may be utilized instead of weld 7 or bolt 6. Any material which is resistant to the environment of the support device can be utilized for the clips, as well as for the bolts or welds.

While a specific embodiment of the invention has been shown and described in detail to illustrate the application of the principles of the invention, it will be understood that the invention may be embodied otherwise without departing from such principles.

The invention claimed is:

1. A tube bundle support device for supporting a plurality of horizontally disposed tubes from a vertical tubular support member, comprising:

a multiplicity of sleeve portions; each sleeve portion including:

a semi-circular midsection having radially opposite ends, and a pair of flanges extending radially outwardly of the ends of the semi-circular midsection, said semi-circular midsection having an inner face adapted to rest against the vertical tubular support member and having an outer face, and a tube hook integrally with said sleeve portion midway of the arc of the outer face of the semi-circular midsection and projecting outwardly from an edge of the midsection in an arcuate vertical path to engage about a horizontal tube to be supported;

each of said sleeve portions being mounted to the vertical tubular supported member in vertically and horizontally mirror-image relationship in respect of an identical sleeve portion;

means for fastening the horizontally opposite sleeve portions to each other; and means for axially fixing said sleeve portions to the vertical tubular support member.

2. A tube bundle support device according to claim 1, in which the fastening means comprises a weldment.

3. A tube bundle support device according to claim 1, in which the fastening means comprises means for bolting the flanges of horizontally opposite sleeve portions to each other and in which each of the flanges has an opening for receiving said bolting means.

4. A tube bundle support device according to any one of the preceding claims in which the tube hook tapers in a direction extending outwardly from said semi-circular midsection.

* * * * *